United States Patent [19]

Riblet

[11] 4,127,831

[45] Nov. 28, 1978

[54] BRANCH LINE DIRECTIONAL COUPLER HAVING AN IMPEDANCE MATCHING NETWORK CONNECTED TO A PORT

[76] Inventor: Gordon P. Riblet, 27 Roberts Rd., Wellesley, Mass. 02181

[21] Appl. No.: 766,431

[22] Filed: Feb. 7, 1977

[51] Int. Cl.[2] ..... H01P 5/18

[52] U.S. Cl. ..... 333/10; 333/33; 333/35

[58] Field of Search ..... 333/10

[56] References Cited

U.S. PATENT DOCUMENTS

| | | | |
|---|---|---|---|
| 2,775,737 | 12/1956 | Purcell | 333/10 X |
| 3,092,790 | 6/1963 | Leake et al. | 333/10 |
| 3,571,762 | 3/1971 | Smilen | 333/10 |
| 3,593,208 | 7/1971 | Smith | 333/10 |
| 3,772,616 | 11/1973 | Imoto | 333/10 X |
| 3,899,756 | 8/1975 | Bodonyi | 333/10 |

*Primary Examiner*—Paul L. Gensler
*Attorney, Agent, or Firm*—Wolf, Greenfield & Sacks

[57] ABSTRACT

The invention is an improvement over the conventional branch guide directional coupler and gives better performance by providing flatter coupling over a broader band. A branch guide (line) directional coupler fundamentally is a four port electrical network. The invention improves the performance of the conventional branch guide coupler by employing matching devices at the ports of the fundamental network. In most embodiments of the invention, it is contemplated that matching devices will be used at each of the ports and that all those matching devices will be of like construction. However, it is not essential that a matching device be employed at every port nor is it essential that all the matching devices be of like construction. For example, in some embodiments of the invention, matching structures need be employed only at the output ports. In the stripline and microstrip embodiments of the invention the matching device can be formed by a half wavelength open-circuited stub in combination with a quarter wavelength transformer or by a short-circuited quarter wavelength stub in combination with a quarter wavelength transformer. Although the invention is described principally in strip line or microstrip form, the invention can also be embodied in waveguide or coaxial form.

26 Claims, 16 Drawing Figures

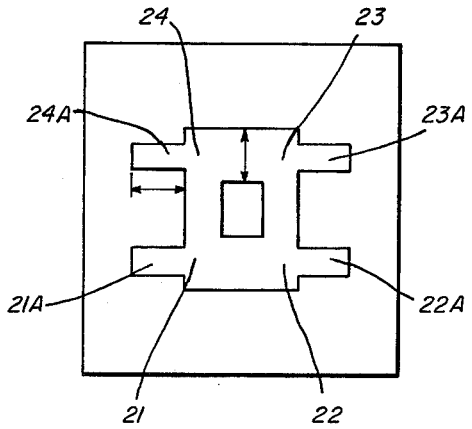
Fig. 10
Fig. 11A
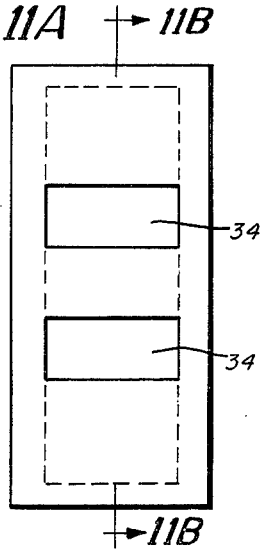
Fig. 11B
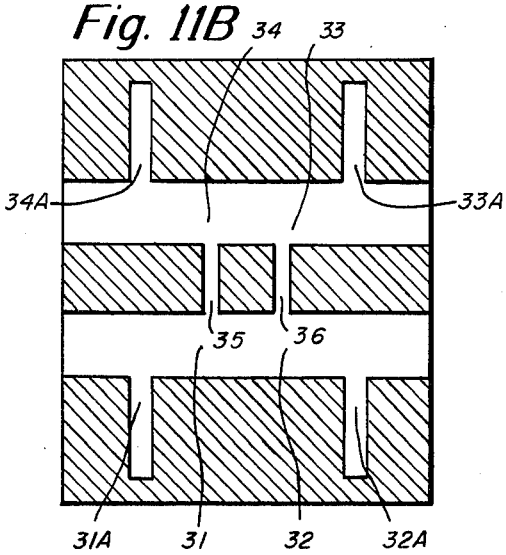
Fig. 12
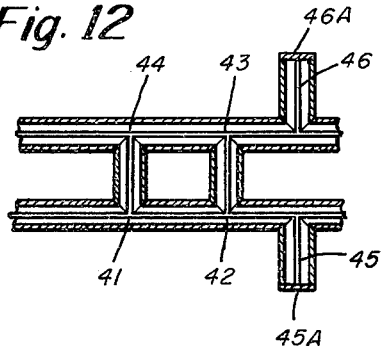
Fig. 13
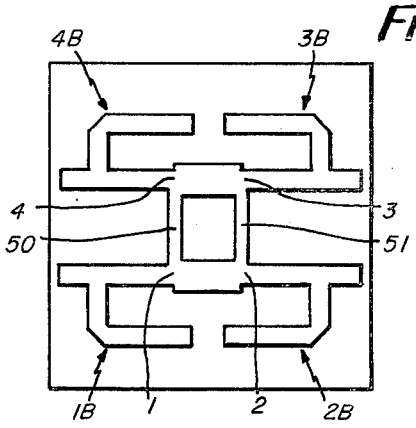

BRANCH LINE DIRECTIONAL COUPLER HAVING AN IMPEDANCE MATCHING NETWORK CONNECTED TO A PORT

BACKGROUND OF THE INVENTION

The present invention relates generally to branch line directional couplers which may be of the strip line, microstrip, coaxial, or waveguide type. More particularly, the invention relates to a four port power-coupling network provided with like matching networks at each port to provide matching at more than one frequency and characterized by a very flat VSWR curve.

PRIOR ART

FIGS. 1A and 1B show two structures of a prior art coupler network in strip line construction. FIG. 1A depicts the fundamental structure which is a four port device comprising four networks each of preferably quarter wavelength. This coupler inherently is matched at only a single frequency which is usually selected at the center frequency of the desired operating band. For example, if the operating band is the 3.7–4.2 GHZ band then the device is perfectly matched at only the center frequency of 3.95 GHZ. Proper balance is obtained only at that frequency and the VSWR is at 1.0 only at the center operating frequency. If the coupler is constructed as a quadrature hybrid equal power coupling from the input port to the output ports occurs at the center frequency. To improve the VSWR bandwidth it is known to add further branch networks, or in the case of strip line devices to add further network strips essentially in parallel as depicted in FIG. 1B. For examples and discussions of prior art branch line couplers refer to C. G. Montgomery, R. H. Dicke, and E. M. Purcell, *Principles of Microwave Circuits,* McGraw-Hill, New York, 1948; J. Ried and G. J. Wheeler, "A Method of Analysis of Symmetrical Four-Port Networks", IRE Trans. Microwave Theory and Technology, Vol. MTT-4, P. 246–252, Oct. 1956; and R. Levy and L. F. Lind, "Synthesis of Symmetrical Branch-Guide Directional Couplers", IEEE Trans. Microwave Theory and Tech., Vol. MTT-16, P. 80–89, Feb. 1968. These added networks tend to flatten the VSWR curve for the device and do somewhat broaden the band over which proper coupling is obtained. However, even though the device is matched at more than one frequency, the power division has not substantially changed as is apparent from the curve of FIG. 9. Thus, with the prior art branch line couplers it has not been possible to obtain a flat power division band width over an appreciable band such as up to a 30% band.

OBJECTS OF THE INVENTION

One object of the present invention is to provide a branch line directional coupler that has an improved broad band coupling performance in comparison to known branch line couplers.

Another object of the present invention is to provide a branch line directional coupler characterized by a very flat VSWR curve by providing matching at more than one frequency in the operating band.

Still another object of the present invention is to provide a branch line directional coupler characterized by improved power division over a relatively large portion of the operating band. In accordance with the invention flat power division is possible over bandwidths up to 30% of the operating band.

A further object of the present invention is to provide a branch line directional coupler having in addition to improved VSWR, also improved isolation and return loss.

Still another object of the present invention is to provide a four port coupler that is relatively simple in construction, easy to fabricate and relatively compact in size.

Another object of the present invention is to provide a branch line coupler that can be constructed as a quadrature hybrid with equal coupling at the output ports and that can be constructed in many different forms such as in strip line microstrip, coaxial, or waveguide construction.

SUMMARY OF THE INVENTION

To accomplish the foregoing and other objects of this invention there is provided a branch line directional coupler which is comprised of four interconnected lossless two port networks interconnected to form four ports including an input signal port and a pair of output ports. Actually, any port of the coupler can be an input port. In order to provide an improved VSWR and flat coupling, in the preferred structure like two port matching networks are respectively coupled independently at each port of the coupler. For some applications only two matching networks may be used. For example, two networks may be used at the output only if matching is not critical at the input ports of the device. By the proper selection of the admittances of the fundamental networks comprising the coupler the coupler functions as a quadrature hybrid with equal power division over a relatively wide bandwidth. In the disclosed embodiment wherein the coupler is of strip line construction, each of the matching networks comprises a stub (strip) and associated quarter wavelength transformer extending from the ports of the coupler. The stub may be a shorted stub of quarter wavelength or an open stub of half wavelength. Under some conditions matching can be accomplished using only a quarter wavelength transformer without the stub (stubless version). The concepts of the invention are also applicable in the construction of waveguide and coaxial couplers.

BRIEF DESCRIPTION OF THE DRAWINGS

Numerous other objects, features and advantages of the invention should now become apparent upon a reading of the following detailed description taken in conjunction with the accompanying drawings, in which:

FIG. 10 shows a strip line branch coupler of the stubless type including a transformer at each port;

FIGS. 11A and 11B are end and cross-sectional views, respectively, of a waveguide version constructed as a 10db coupler;

FIG. 12 shows a coaxial version of the invention;

FIG. 13 shows a diagram like the one of FIG. 5 but for a 10db coupler; and

EXPOSITION

Figure 1A:
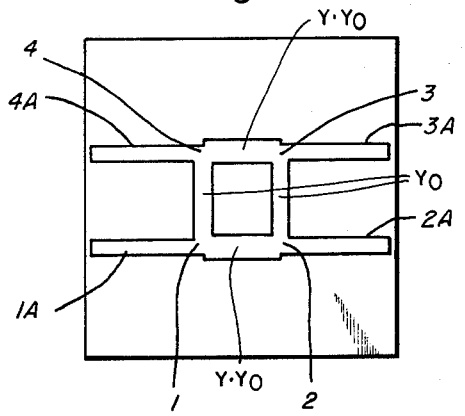
FIG. 1A is a schematic diagram of a prior art branch line directional coupler.
Figure 1B:
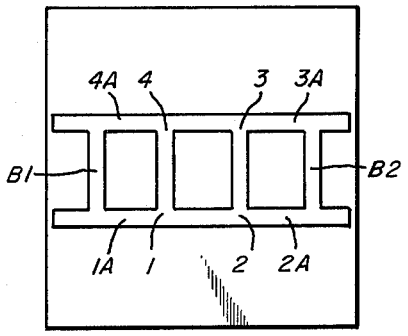
FIG. 1B is a schematic diagram of a prior art branch coupler having several branches.
Figure 9:
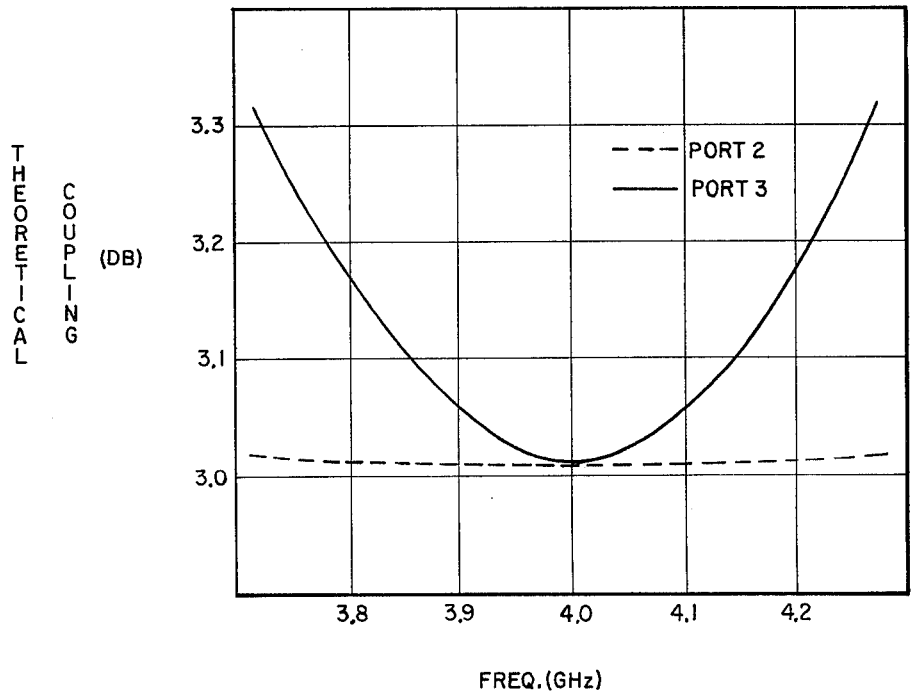
FIG. 9 is a coupling curve for a prior art branch line coupler, of one or several branches.

As previously discussed, FIG. 1A shows a fundamental prior art coupler of strip line construction comprised of four interconnected networks forming the ports 1, 2, 3 and 4. As previously mentioned, the performance of this coupler can be improved as far as the flatness of the VSWR is concerned by a previously known technique of providing additional branch lines or strips coupled essentially in parallel with the device. FIG. 1B shows a typical branch line coupler provided with additional conductive strips B1 and B2. Three branches may also be used with all lengths being the same. Strip B1 couples between strips 1A and 4A, while strip B2 couple between strip 2A and 3A. With any of these prior art branch line couplers, although there is an improvement in VSWR the branch line coupler still has a parabolic curvature characteristic as far as the coupling is concerned with ideal coupling still at the most at only two frequencies. FIG. 9 shows coupling curves at the output ports indicating the single frequency match and still basically parabolic curvature.

Figure 2:
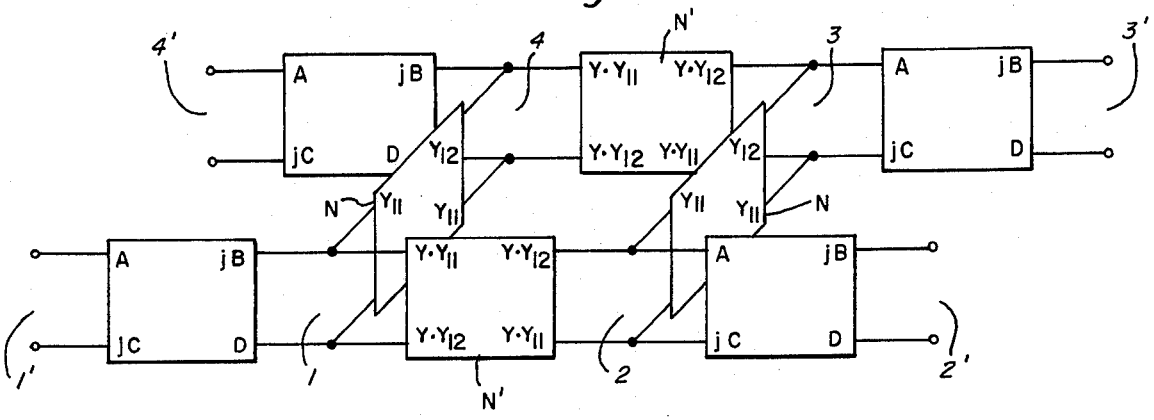
PRIOR ART Fig. 2
FIG. 2 is a schematic diagram in two wire form illustrating the networks comprising the directional coupler of this invention.

In accordance with the present invention, instead of adding branch lines, a two port matching network is connected at each port of the coupler. Each of the matching networks is connected independently at the port with no interconnections between adjacent matching networks. FIG. 2 shows a four port electrical network in two wire form comprised of four networks interconnected between the ports 1, 2, 3 and 4. The ports 1 and 4 and the ports 2 and 3 are connected by a two port network N whereas the ports 1 and 2 and the ports 3 and 4 are connected by a different two port network N'. The networks N and N' are both lossless, reciprocal and symmetrical networks. Because these networks are reciprocal and symmetrical the relations $Y_{22} = Y_{11}$, and $Y_{21} = Y_{12}$ hold for the admittance matrix elements shown in FIG. 2 which specify each of the two port networks. Furthermore, the network N' is actually the same as network N except for the factor of the admittance level Y. The network N' is equal to this level Y times that of the network N. The admittance matrix elements of network N' as shown in FIG. 2 are given by; $Y'_{11} = Y \cdot Y_{11}$ and $Y'_{12} = Y \cdot Y_{12}$. FIG. 2 also shows the matching network in accordance with the present invention represented by the elements of an ABCD matrix connected at each of the ports 1, 2, 3, and 4 shown in FIG. 2.

The device shown in FIG. 2 with its particular symmetry regarding the networks N and N' functions as a perfect directional coupler if it is matched. It will be matched if no incident power is reflected at the input port 1 with port 4 being isolated while power couples out of ports 2 and 3 in some ratio. However, in accordance with this invention by selecting a two port matching network connected at each of the input ports 1, 2, 3 and 4 matching can occur at a number of frequencies and in particular at two frequencies as disclosed hereinafter.

Figure 8:
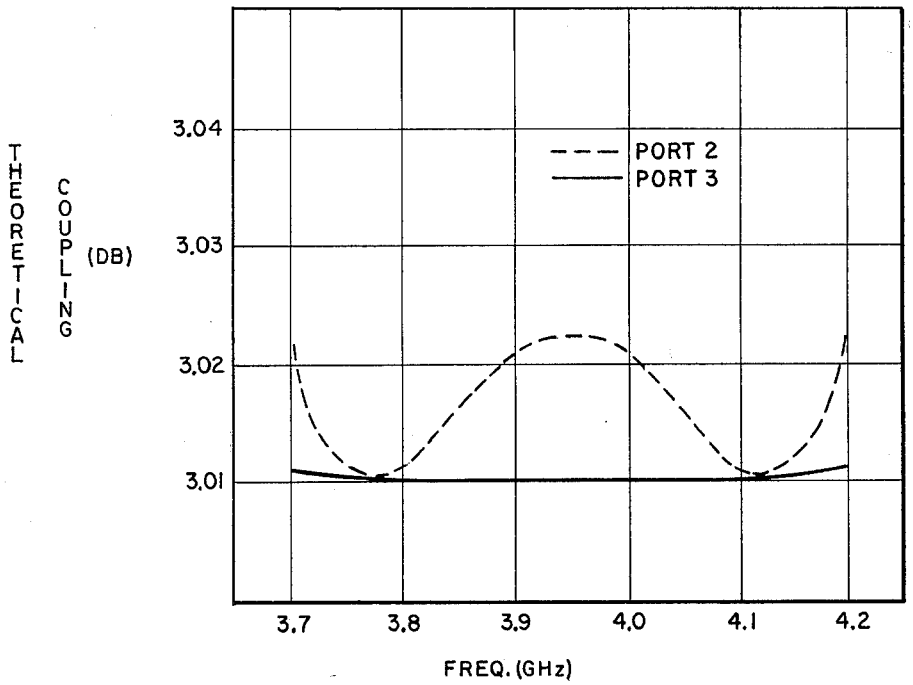
FIG. 8 is a curve associated with the directional coupler of this invention plotting coupling (db) against frequency.

It can be shown by mathematical derivation that for all the matched frequencies the coupling ratio will be the same for a four port network of the specified form, and is given by the following equation:

$$|S_{12}/S_{13}| = \sqrt{Y^2-1} \quad (1)$$

where $S_{12}$ is the amplitude of the signal transmitted to port 2 from port 1; $S_{13}$ is the amplitude of the signal transmitted to port 3 from port 1; and $Y$ is the admittance level ratio between the networks N and N'. By selecting a matching network which, when connected at each of the ports 1, 2, 3, and 4, matches the four port network at a number of frequencies, then very flat coupling is obtained over a frequency band including these frequencies since the coupling will be the same all frequencies at which the device is matched. The curve of FIG. 8 gives a clear indication of this coupling characteristic. A similar result is not obtained for the multibranch coupler of FIG. 1B (See FIG. 9), as it does not fall into the category of network shown in FIG. 2.

The next step is to determine the equivalent admittance into which the matching network (represented by the ABCD matrix in FIG. 2) has to match in order to be able to determine an appropriate matching network. If a two port matching network represented by the ABCD matrix matches into this complete admittance, then the same two port network connected at each of the four ports 1, 2, 3, and 4 yields a matched device when looking into ports 1', 2', 3' and 4'. The expression for the equivalent admittance is given by the general expression:

$$Y_{eq} = G' + jY'$$

and more specifically by:

$$Y_{eq} = \sqrt{Y^2-1}\, Y_{12} + j\,(1+Y)\, Y_{11} \quad (2)$$

where $Y_{11}$ and $Y_{12}$ are the elements of the admittance matrix for the two port network N as shown in FIG. 2. The real part of the equivalent admittance is the conductance and the imaginary part is the susceptance. If A, B, C and D are the elements of the ABCD matrix of the matching network which has been connected at each of the four ports, then the matching conditions become:

$$1 = (B^2 + D^2)\sqrt{Y^2-1} \cdot Y_{12} = (B^2 + D^2)\, G' \quad (3)$$

$$(AB-CD) = (B^2 + D^2)(1+Y) \cdot Y_{11} = (B^2 + D^2)\, Y'. \quad (4)$$

The final ABCD matrix is obtained by multiplying the matrix for a transformer by the matrix for a stub.

Equations 3 and 4 may be used to design directional couplers with flat coupling in either strip line, microstrip, coax or waveguide transmission lines. However, an example may be helpful illustrating a particular design procedure. Consider a four port strip line device of the type shown in FIG. 2 in which the network N is simply a length of transmission line of electrical length $\theta$ and unit admittance $Y_o = 1$ as in FIG. 1A. The network N' connecting ports 1 and 2 as well as ports 3 and 4 is also a length of transmission line with the same electrical length $\theta$ but with a characteristic admittance Y. It is further assumed that the coupler is a quadrature hybrid with equal coupling at the output ports. There is thus equal power division between ports 2 and 3 so that $|S_{12}| = |S_{13}|$. It follows from equation (1) that then $Y = \sqrt{2}$. For the particular structure chosen $Y_{11} = -\cot\theta$ and $Y_{12} = 1/\sin\theta$. It then follows from equation (2) that:

$$Y_{eq} = 1/\sin\theta - j(1+\sqrt{2})\cot\theta \quad (5)$$

It can be seen from equation (5) that when $\theta = 90°$ corresponding to a quarter wavelength, the equivalent admittance is one. In the vicinity of $\theta = 90°$, the equivalent admittance has the approximate form of a unit resistance shunted by a short-circuited stub of electrical length $\theta$ and admittance level $(1+\sqrt{2})$.

Figure 3:
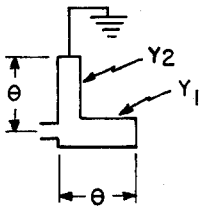
FIG. 3 shows one embodiment for a matching network of the invention.

FIG. 3 shows a matching network that may be used with the fundamental coupler structure. This network as shown in FIG. 3 comprises a quarter wavelength transformer of electrical length $\theta$ and admittance level $Y_1$ shunted by a short-circuited stub of the same electrical length $\theta$ and characteristic admittance $Y_2$. As previously mentioned, the resultant ABCD matrix is obtained by multiplying together the ABCD matrices for the stub and transformer. The resultant matrix elements are then substituted into equations (3) and (4). Next, the real and imaginary parts of equations (5) are substituted into equations (3) and (4) and the following matching conditions result:

$$\sin^2\theta/Y_1^2 + (1+Y_2/Y_1)^2\cos^2\theta = \sin\theta \quad (6)$$

$$\sin\theta/Y_1 - (1+Y_2/Y_1)(Y_1\sin\theta - Y_2\cos^2\theta/\sin\theta) = -(1+\sqrt{2}) \quad (7)$$

The equations (6) and (7) can be solved simultaneously to determine the two unknown characteristic admittances $Y_1$ and $Y_2$. Further, these equations are unchanged if the electrical length $\theta$ is replaced by $180° - \theta$. There will thus be two frequencies of perfect match symmetrically located about the center frequency corresponding to these two electrical lengths. If additional matching stubs and quarter wavelength transformers are provided at each port, still further frequencies exist of ideal match. For example, each port of the device may have two matching stubs associated therewith.

Figure 4:
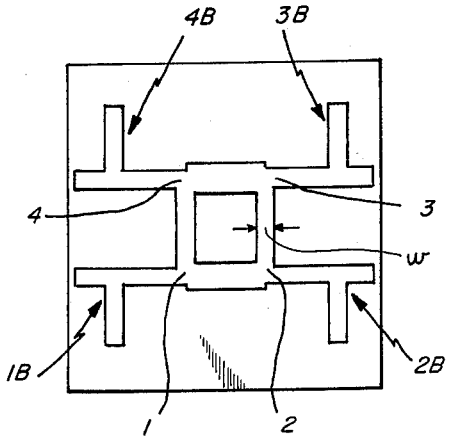
FIG. 4 shows the coupler structure with the matching network of FIG. 3.
Figure 7:
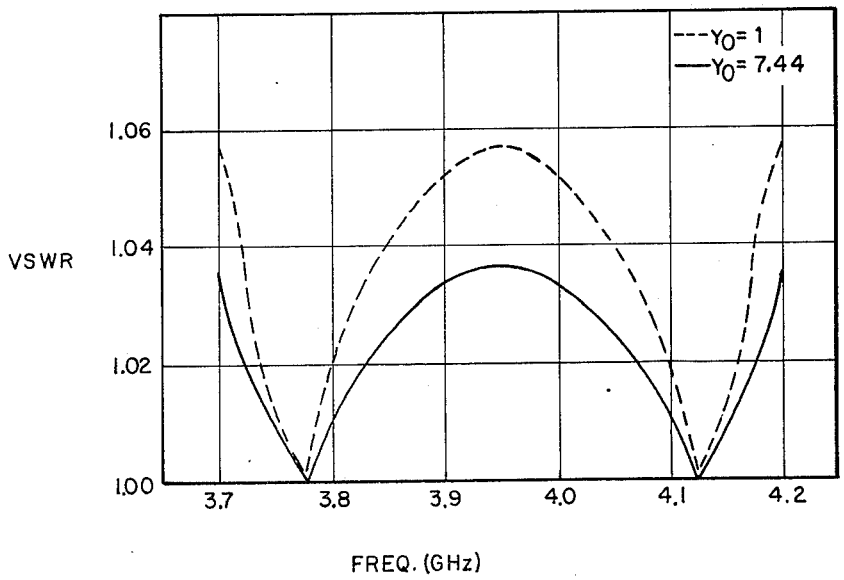
FIG. 7 is a curve associated with the directional coupler of this invention plotting VSWR against frequency.

FIG. 4 shows the directional coupler with the matching networks 1B, 2B, 3B and 4B coupled to the respective ports 1, 2, 3 and 4 of the branch line directional coupler. The curves shown in FIGS. 7 and 8 are associated with the embodiment of FIG. 4 and give the theoretical performance (VSWR and coupling to ports 2 and 3, respectively) for a strip line matched hybrid optimized for the 3.7–4.2 GHZ band by a proper choice of $\theta$;

$$\theta \simeq \cos^{-1}\sqrt{1/2}\cos(\pi/2\,(1+\Delta f/f))$$

where $\Delta f/f$ is normalized bandwidth.

For $Y_1 = 1.026$ and $Y_2 = 2.39$ the VSWR is less than 1.06 and the coupling imbalance is about 0.012 db although the theoretical coupling imbalance can be made less than 0.006 db maximum over this band. With this matching structure there is a flat coupling in comparison with other devices of bandwidths up to 30%. The balance is perfect as noted in the curves at those frequencies for which the VSWR = 1. Furthermore, the coupling to port 2 has a ripple and not the usual parabolic curvature characteristic of branch line couplers such as the type shown in FIG. 1B.

As previously mentioned the coupler of this invention can be constructed as a quadrature hybrid by the proper selection of the admittance values of network N and N'. For the quadrature hybrid it has been shown that the ratio is in the magnitude $\sqrt{2}$. However, by slightly varying this ratio the curves of FIG. 8 can be moved essentially relative to each other thereby crossing each other so that there are four frequencies at which coupling is the same and ideal. Thus, matching frequencies may be, for example, at two spaced frequencies about 3.78GHZ and two other spaced frequencies about 4.12 GHZ.

Figure 5:
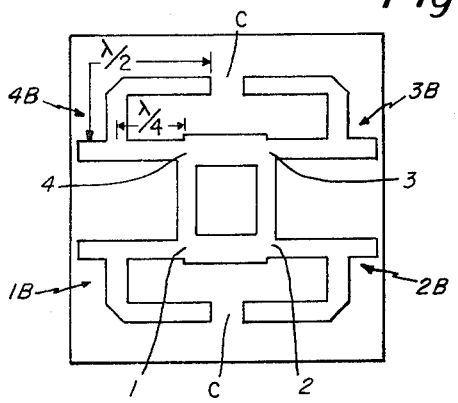
FIG. 5 shows another preferred embodiment of the directional coupler with a half wavelength matching stub.
Figure 6:
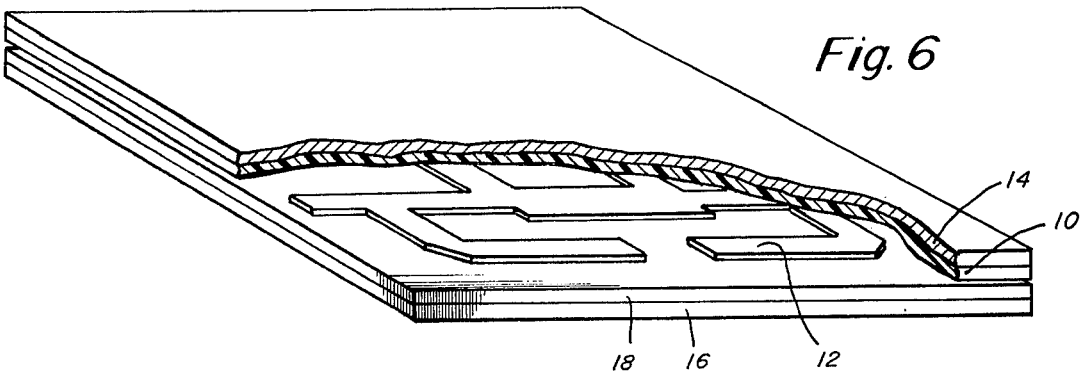
FIG. 6 is a cross-sectional view taken through the embodiment of FIG. 5 showing the construction of a complete device.

FIGS. 5 and 6 show another embodiment of the present invention. Instead of short-circuited stubs as indicated in FIGS. 3 and 4, open circuited stubs of electrical length equal to $2\theta$ and characteristic admittance $Y_2 = 1.195$ ($= \frac{1}{2}\,Y_2$ for short-circuit stub) were used thereby making the construction simpler. As indicated in FIG. 5 these stubs, having a longer length, are folded back to make the construction more compact. However, the gap (c) is made sufficiently long to prevent any cross talk between the facing stubs.

FIG. 6 in particular shows in a cross-sectional view the basic components of the device. In FIG. 6 the different layers comprising the device can be interconnected in a suitable manner. The strip line device is primarily embodied on a printed circuit board 10 having clad thereto the conductor 12 which is constructed in the form clearly depicted in FIG. 5. The device also comprises in a sandwich construction ground planes 14 and 16 and a blank insulating sheet 18. Connections can be made in a conventional manner to the etched conductor 12 at the appropriate ports.

The network pattern shown in FIG. 5 can be constructed in a well known manner. A photoresist is applied to a copper-clad printed circuit board and predetermined areas of the board have the copper etched therefrom leaving the pattern of FIG. 5. The strips comprising the device can be trimmed easily to provide the proper admittance values for the basic structure and the matching stubs.

In the example previously given the operating frequency was about a center frequency of 3.95 GHZ. Devices for operation at different frequencies can be easily constructed by a simple scaling operation. For a quadrature hybrid the ratio between admittances for the basic network would remain $\sqrt{2}$ but the electrical lengths would change in a scaled ratio to operating frequency. Of course, the previously cited equations would be used to calculate admittance values of the stubs for the new frequency band.

Many modifications of the matching network are possible which also will provide a low VSWR and very flat coupling over bandwidths up to at least 30%. For instance, the stub may be replaced by a lump element shunt resonant LC circuit with the capacitance C and the inductance L chosen to give the same center frequency and susceptance-slope parameter as the stub. This is advantageous at the lower end of the microwave spectrum where the stub becomes quite long. Likewise, the basic structure of the junction may be modified while still remaining with the general structure represented by FIG. 2. For example, the admittance $Y_0$ need not be selected at unity but could be some number larger than unity which would actually improve the performance after matching over a given bandwidth (See solid curve of FIG. 7).

FIG. 10 shows a schematic diagram similar to that shown in FIGS. 4 and 5 but for the stubless version of the present invention. This device is of strip line construction and has an etched conductor defining the four ports 21, 22, 23, and 24. These ports 21, 22, 23 and 24 have associated therewith quarter wavelength transformers 21A, 22A, 23A and 24A, respectively. It is noted in the version of FIG. 10 that the strips defining the ports are of a substantially larger width than the embodiments shown in FIGS. 4 and 5. The widths of these strips are calculated as being 2w whereas the width as depicted in FIG. 4 is w.

In the design procedures for the coupler of this invention there are actually three variables, namely $Y_0$, $Y_1$, $Y_2$ that must be chosen. By assuming that the stub is eliminated, the variable $Y_2$ is therefore eliminated and one can solve the equations such as equations 6 and 7 for the admittances $Y_1$ and $Y_0$. Upon doing this a structure like that shown in FIG. 10 is developed. As previously mentioned with this arrangement, the width of the strips is twice that shown in an arrangement like FIG. 4 and the transformers have a width of 1.414w. The arrangement of FIG. 10 may have some applications but there is a problem with this arrangement in that the equations show that $Y_0$ must be quite large and consequently this arrangement gives rise to junction effect problems. This is apparent from FIG. 10 where the ports are large and relatively close together so that the conditions for junction effect problems are present.

FIGS. 11A and 11B show a waveguide version of the present invention as a 10db coupler. With such a coupler the power division of the output ports is in he ratio of one-to-ten. In the arrangement of FIGS. 11A and 11B there are two main guide channels defining the ports 31, 32, 33 and 34. The two cross channels 35 and 36 connect between the main channels and provide the cross coupling for the coupler. It is noted that because this is a 10db coupler the channels 35 and 36 are of a substantially lesser width than the width of the main through channels. FIG. 11B clearly shows the stubs 31A, 32A, 33A, 34A each respectively associated with the ports 31, 32, 33 and 34. Each of the stubs can be a short section of terminated waveguide. In this waveguide version the height of the sections of the guide is proportional to the required characteristic admittance levels.

FIG. 12 shows a coaxial transmission line version of the present invention comprising coaxial transmission line sections defining ports 41, 42, 43 and 44 defining the basic structure of the device. In this particular arrangement only two stubs are provided shown in FIG. 12 as terminating conductors 45 and 46 associated respectively with output ports 42 and 43. The conductors 45 and 46 are terminated to the outer shield by conductive plates 45A and 46A, respectively. The arrangement of FIG. 12 may be used in an application where one is not concerned with a match at the input ports. For example, the structures shown in FIG. 12 may be used as a power divider where input match is not as important as flat power coupling out of the output ports.

The use of only two matching networks may also apply in the strip line construction where the device may be used as an isolator or a power switch, for example. In some of these applications diodes are connected at the output ports. These diodes inherently have series and shunt reactance which causes some imbalance problems when employed with branch couplers or the basic coupler. However, with the structure of this invention compensation for these diode parameters can be made quite easily by trimming the length of the stubs thereby changing the electrical length $\theta$ to compensate for this diode reactance. Usually, only the stub having the diode associated therewith is trimmed.

The embodiment shown in FIG. 13 is substantially the same as that shown in FIG. 5 and thus like reference characters will be used to identify similar parts in these two diagrams. The primary difference in the embodiment of FIG. 13 is that this coupler has been constructed as a 10*db* coupler having uneven power division at the output ports 2 and 3. In this particular arrangement it is noted that the strips 50 and 51 have a width substantially less than the other strips comprising the basic structure. The equations can be solved to yield the proper admittances for these cross strips. With this arrangement the power coupling is in the ratio of ten-to-one between the ports 2 and 3, respectively.

Figure 14:
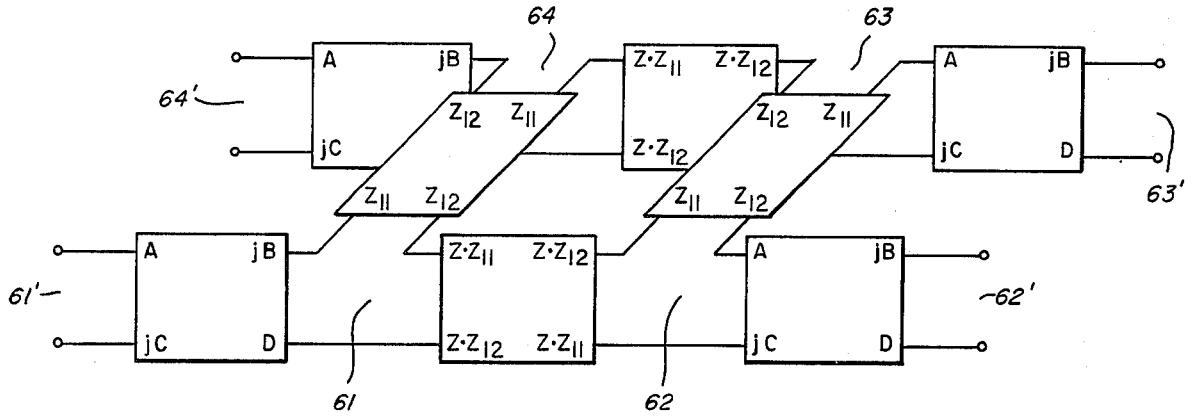
FIG. 14 is a schematic diagram in two wire form illustrating series connections of the two port matching networks.

FIG. 14 is a schematic diagram in two wire form illustrating series connections of the two port matching networks. This diagram is quite similar to the one previously shown in FIG. 2 except that the diagram of FIG. 2 was for the preferred connection or parallel connection of the two port matching networks. In FIG. 14 the matching networks are still represented by the ABCD matrix but the basic network is now represented by an impedance matrix rather than an admittance matrix. Each of the four ports comprising the basic network is represented by its own impedance matrix. The diagram of FIG. 14 may actually be considered as a dual form of the diagram of FIG. 2 and is similar to the case of parallel connections if admittances are everywhere replaced by impedances.

The embodiment of FIG. 14 may be practically applied in the waveguide coupler version of this invention. For this version the important quantity is the equivalent impedance $Z_{eq}$ which is given by the following equation:

$$Z_{eq} = \sqrt{Z^2-1}\, Z_{12} + j(1+Z)\, Z_{11}$$

The power division is now determined by the following equation:

$$Z = \sqrt{|S_{12}|^2/|S_{13}|+1}$$

Having described a limited number of embodiments of this invention, it should now become apparent to those skilled in the art that the principles herein disclosed can be applied to construct many different versions of the invention.

What is claimed is:

1. A symmetrical two branch coupler comprised of four sections of signal transmission line interconnected so as to form at the junction therebetween four ports of the coupler with oppositely disposed lines having like characteristic admittances, the improvement comprising at least two two-port matching networks connected respectively at two of the four ports of the coupler with each matching network connected at its associated port and independent of connection to the other ports, each matching network comprising at least a portion of transmission line and a stub means connected to said portion of transmission line at a point remote from the coupler port, said matching network capable of matching both resistive and reactive impedance components.

2. A coupler as set forth in claim 1 having at least three two-port matching networks, each connected to a port of the coupler.

3. A coupler as set forth in claim 1 wherein each portion of transmission line comprises a section of transformer.

4. A coupler as set forth in claim 1 wherein said matching networks provide matching and ideal coupling at more than one frequency.

5. A coupler as set forth in claim 1 wherein said coupler has rotational symmetry about two orthogonally disposed axes.

6. A coupler as set forth in claim 1 wherein said sections of transmission line are connected in parallel.

7. A coupler as set forth in claim 1 wherein said sections of transmission line include first and second pairs of sections, both sections in a pair having identical admittance matrices, with each pair having different admittance matrices differing from each other by a multiplicative constant.

8. A coupler as set forth in claim 2 wherein all matching networks are alike.

9. A coupler as set forth in claim 2 wherein said stub means comprises a strip of conductive material of one-half wavelength.

10. A coupler as set forth in claim 9 wherein said stub strips are arranged in pairs, one being associated with an input port and the other associated with an output port with the two stub strips having their free ends extending in facing relationship but defining a gap therebetween.

11. A coupler as set forth in claim 10 wherein said portion of transmission line comprises a one quarter wavelength transformer strip.

12. A coupler as set forth in claim 2 wherein said stub means comprises a strip of conductive material of one quarter wavelength terminated to ground.

13. A coupler as set forth in claim 2 wherein each said stub means has a length of substantially one half wavelength and is of L-shape.

14. A coupler as set forth in claim 2 wherein the coupler is of strip line construction comprising a ground plane with all matching networks comprising stubs contiguously extending from the port.

15. A coupler as set forth in claim 2 wherein the coupler includes an etched printed circuit board having the etching conductor defining the device in combination with a ground plane and an insulation board arranged in a sandwich construction.

16. A coupler as set forth in claim 2 wherein said sections of transmission line comprise sections of waveguide, said matching networks being defined by terminated guide stubs.

17. A coupler as set forth in claim 2 wherein the admittance values of the sections of transmission line are preselected to provide equal power division at the output ports of the coupler.

18. A coupler as set forth in claim 2 wherein the admittance values of the sections of transmission line are preselected to provide unequal power division at the output ports of the coupler.

19. A coupler as set forth in claim 18 wherein the coupler is constructed as a 10db coupler.

20. A ccupler as set forth in claim 2 wherein the sections of transmission line comprise sections of coaxial transmission line, said matching networks being defined by terminated coaxial stubs.

21. A coupler as set forth in claim 2 wherein said sections of transmission line are connected in series.

22. A coupler as set forth in claim 2 wherein the sections of transmission line defining the branches comprise sections of transmission line of the same electrical length.

23. A coupler as set forth in claim 2 wherein said matching networks provide matching and ideal coupling at more than one frequency.

24. A coupler as set forth in claim 2 wherein said coupler has rotational symmetry about two orthogonally disposed axes.

25. A coupler as set forth in claim 24 wherein any one of the four ports of the symmetrical coupler may function as an input port.

26. A coupler as set forth in claim 2 wherein each portion of transmission line comprises a section of transformer.

* * * * *